US008555594B2

(12) United States Patent
Grandi

(10) Patent No.: US 8,555,594 B2
(45) Date of Patent: Oct. 15, 2013

(54) MULTIFUNCTIONAL BEAM FOR SUB-CEILINGS, SUB-CEILING STRUCTURE AND MODULAR SYSTEM FOR CUSTOMIZED SUB-CEILING STRUCTURE INCORPORATING SUCH BEAM

(75) Inventor: Ruggero Grandi, Quinto Vicentino (IT)

(73) Assignee: Gemino S.R.L., Padova (IT)

( * ) Notice: Subject to any disclaimer, the term of this patent is extended or adjusted under 35 U.S.C. 154(b) by 27 days.

(21) Appl. No.: 13/001,546

(22) PCT Filed: Feb. 18, 2009

(86) PCT No.: PCT/IB2009/050665

§ 371 (c)(1),
(2), (4) Date: Feb. 22, 2011

(87) PCT Pub. No.: WO2009/153674

PCT Pub. Date: Dec. 23, 2009

(65) Prior Publication Data

US 2011/0131900 A1 Jun. 9, 2011

(30) Foreign Application Priority Data

Jul. 11, 2008 (IT) ..... TV2008A0092

(51) Int. Cl.
*E04B 2/00* (2006.01)

(52) U.S. Cl.
USPC ..... 52/506.05; 52/506.01

(58) Field of Classification Search
USPC ..... 52/506.01, 506.05, 173.1
See application file for complete search history.

(56) References Cited

U.S. PATENT DOCUMENTS

| | | | | |
|---|---|---|---|---|
| 3,327,438 | A * | 6/1967 | Cooper | 52/205 |
| 3,504,172 | A | 3/1970 | Liberman | |
| 3,742,674 | A * | 7/1973 | Lang | 52/666 |
| 5,454,756 | A | 10/1995 | Ludwig | |
| 6,511,522 | B1 * | 1/2003 | Gomez et al. | 55/385.2 |
| 7,886,496 | B1 * | 2/2011 | Spransy | 52/506.06 |

FOREIGN PATENT DOCUMENTS

| | | |
|---|---|---|
| DE | 2435301 | 2/1976 |
| EP | 0464367 | 1/1992 |
| EP | 0627532 | 12/1994 |

* cited by examiner

*Primary Examiner* — Mark Wendell
(74) *Attorney, Agent, or Firm* — Themis Law

(57) ABSTRACT

A multipurpose beam for side-by-side panel false ceiling constructions includes a bearing profile with a pair of side was joined together by a substantially horizontal wall and having a bottom opening, at least one functional element with an anchoring portion designed to be received in the compartment, coupling means for connecting together the profile and the anchoring portion, and support means associated with the profile for supporting at least one panel of a false ceiling construction. The anchoring portion of the functional element is designed to hold the functional element integrated in the profile and entirely contained in the compartment. The support means extend from the side walls to hold the panels substantially flush with the longitudinal edges of the opening. A false ceiling structure and a modular system for customized design of a false ceiling that includes the beam are also provided.

13 Claims, 4 Drawing Sheets

MULTIFUNCTIONAL BEAM FOR SUB-CEILINGS, SUB-CEILING STRUCTURE AND MODULAR SYSTEM FOR CUSTOMIZED SUB-CEILING STRUCTURE INCORPORATING SUCH BEAM

TECHNICAL FIELD

The present invention generally finds application in the civil or industrial building industry and particularly relates to a multipurpose beam for use in a false ceiling of a civil or industrial building.

The invention further relates to a false ceiling structure comprising the beam of the invention and a modular system for customized design of a false ceiling of a civil or industrial construction.

BACKGROUND ART

In modern buildings, prefabricated room partitions, particularly for rooms designed for office use, as well as false ceilings, are known to be critical elements for adequate acoustic, thermal and visual insulation.

The use of false ceilings allows concealment of the cables and pipes that are used for serving the equipment required for adequate comfort of the room.

In practice, the false ceiling delimits a service interspace, which may receive power circuits, heating or air-conditioning pipes, cables for data transfer, telephony and all equipment required for proper operation of service and/or safety apparatus.

Typically, the false ceiling consists of a modular system having a plurality of supporting beams which define a truss having two horizontal rows, with covering panels or plates anchored thereto.

The false ceiling may also be fitted with service devices such as lamps, fire or emergency systems, as well as prefabricated or glazed walls if the available space has to be divided into two or more rooms.

A number of solutions have been known in the art for providing false ceilings and partitioning industrial buildings, which particularly include bearing beams associated with a functional service element, such as a lamp a sound device, a partition and the like.

GB547807 discloses a false ceiling supporting beam having a tubular portion for cables and pipes serving various types of equipment. The beam further has a lower T-shaped part projecting from the floor slab for mounting false ceiling panels thereto.

FR2745316 discloses a downwardly open U-shaped channel beam, which is designed to hold a functional accessory or element therein.

Panels are mounted using two additional support brackets, which are secured or laid onto the beam at its top wall.

U.S. Pat. No. 4,411,116 discloses a downwardly open U-shaped channel beam having grooves and projections for connection with transverse spacers and grooves and projections for supporting electric lines, pipes or other devices.

GB1447050 discloses a tubular channel beam designed to be secured to a floor slab by hangers and open at the bottom for receiving a second upwardly open U-shaped element, which is designed to hold a functional element.

This second element further has a pair of outwardly projecting side tabs for supporting the false ceiling panels.

GB1447050 discloses lighting fixtures integrated in the false ceiling by a ventilation channel beam with a first element laterally supporting a false ceiling panel supporting profile by adjustable screw means.

A second element is supported in the compartment defined by the first element, which second element defines a lighting device holding compartment.

A similar solution is also known from Italian patent application TV2005A000185, by the applicant hereof, in which a first element designed to be anchored to the floor slab is inserted in a second element, with panels being attached to the side ends thereof.

Nevertheless, all prior art solutions suffer from the common drawback of contributing to form a false ceiling which will be generally formed of a plurality of panels with the bearing beams projecting therefrom in a more or less visible manner.

Thus, the construction so obtained will have a lower aesthetic quality, caused by discontinuities in the false ceiling.

Furthermore, prior art solutions provide relatively complex structures with a great number of components, requiring long and difficult assembly procedures and heavier structures, with a difficult maintenance.

Another important drawback is that prior art systems have relatively low or no versatility, and provide a limited opportunity of remodulating room partitioning to adapt rooms to new or different uses.

DISCLOSURE OF THE INVENTION

It is a main object of the present invention to overcome the above mentioned drawbacks by providing a multipurpose beam for false ceilings that has a simple construction and a relatively low weight.

A particular object is to provide a multipurpose beam that, in its mounted state, is wholly integrated in the false ceiling construction with which it is associated.

Yet another object of the present invention is to provide a multipurpose beam that contributes to the formation of false ceilings of superior aesthetic quality with no elements projecting out of the plane defined by the false ceiling.

A particular object to provide a multipurpose beam that is easy to assemble and has a considerably simplified maintenance.

Another important object of the present invention is to provide a false ceiling structure that ensures high versatility, to adapt to various uses and different partitioning arrangements in the space covered by the false ceiling.

These and other objects, as better explained hereafter, are fulfilled by a multipurpose beam for false ceilings, which comprises a bearing profile designed to be suspended from a floor slab, with a pair of side walls joined together at their top by a substantially horizontal wall and having free longitudinal lower edges to define a longitudinal compartment with a bottom opening, at least one functional element with an anchoring portion designed to be received in said compartment, coupling means for connecting together said functional element and said anchoring portion, and support means associated with said that profile for supporting at least one panel of a false ceiling construction.

According to a peculiar feature of the invention, the anchoring portion of said at least one functional element is designed to hold such functional element integrated in said profile and entirely contained in said compartment.

Also, the support means extend from said side wails of said profile to hold the panels substantially flush with said longitudinal edges of said opening.

Thus, once the false ceiling has been assembled, there will be no element projecting out of the undersides of the panels, which will provide a light structure of superior aesthetic quality.

In other aspects, the invention provides a false ceiling structure and a modular system for customized design of a false ceiling.

BRIEF DESCRIPTION OF THE DRAWINGS

Additional features and advantages of the invention will become more apparent upon reading the following detailed description of a few preferred non exclusive embodiments of a multipurpose beam of the present invention, which are described by way of a non limiting example with the help of the accompanying drawings, in which.

DETAILED DESCRIPTION OF A PREFERRED EMBODIMENT

Referring to the above figures, a multipurpose beam according to the invention may be used for forming false ceiling constructions composed of a plurality of side-by-side panels in premises to be divided into multiple rooms by prefabricated walls, glazed panels, curtains, or the like.

Figure 1:
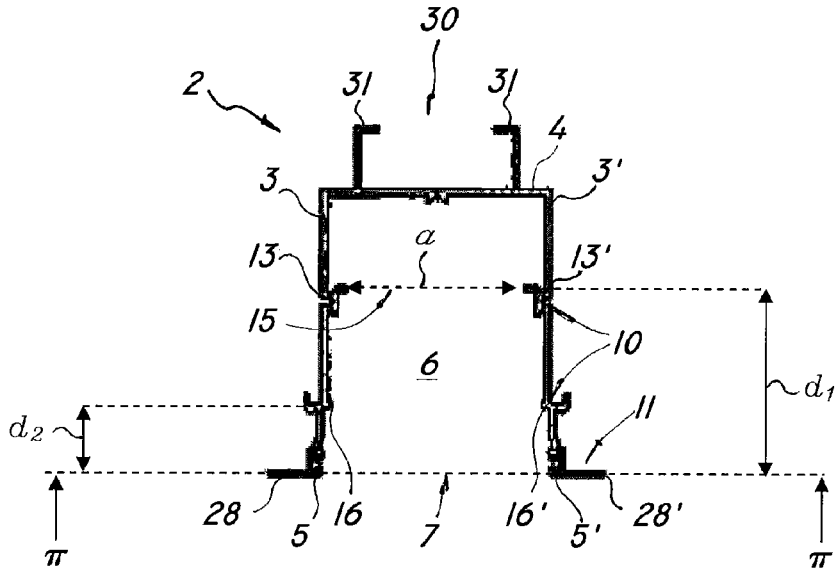
FIG. 1 is a cross sectional view of a profile that is par of a beam according to the invention.

The multipurpose beam, generally designated by numeral 1, comprises a bearing profile 3, as shown in FIG. 1, which is designed to be suspended from a floor slab and has a pair of substantially vertical side walls 3, 3', joined together at their top by a substantially horizontal wall 4.

The side was 3, 3' also have respective free longitudinal lower edges 5, 5' to define a longitudinal compartment 6 with a bottom opening 7.

The beam 1 further has at least one functional element 8, 8', 8'', 8''', . . . having an anchoring portion 9, 9', 9'', 9''', . . . , which is designed be received in the compartment 6, and coupling means 10 for connecting together the profile 2 and the anchoring portion 9, 9', 9'', 9''', . . . .

For clarity purposed, reference will be made herein, unless otherwise stated, to the functional elements and parts thereof by non-indexed reference numerals.

Nevertheless, it shah be understood that all the features of one of the functional elements may be found in a substantially similar manner in the other ones, unless otherwise stated.

The beam also comprises special support means 11 associated with the profile 2 for supporting one or more false ceiling panels P with which the beam 1 may be associated.

As used herein, the term "functional element" shall be intended to indicate any element 8 that can be introduced into the bearing profile 2 and has any function other than supporting the panels P or other elements belonging to the false ceiling with which the beam 1 can be associated.

For instance, the functional element 7 may be a lighting device, an alarm or safety system, a bearing element for a prefabricated panel wall, a plate, a curtain or the like.

According to a peculiar feature of the invention, the anchoring portion 9 of the functional element 8 is designed to hold such functional element 8 integrated in the profile 2 and entirely contained in the compartment 6.

Furthermore, the support means 11 extend from the side walls 3, 3' of the profile 2, preferably external thereto and in the proximity of the lower edges 5, 5', to hold the panels P substantially flush with the longitudinal edges 5, 5' of the opening 7.

By this combination of features, once the beam 1 of the invention is assembled, it will appear as a single body, with no parts projecting out of the plane $\pi$ defined by the opening 7.

Figure 4:
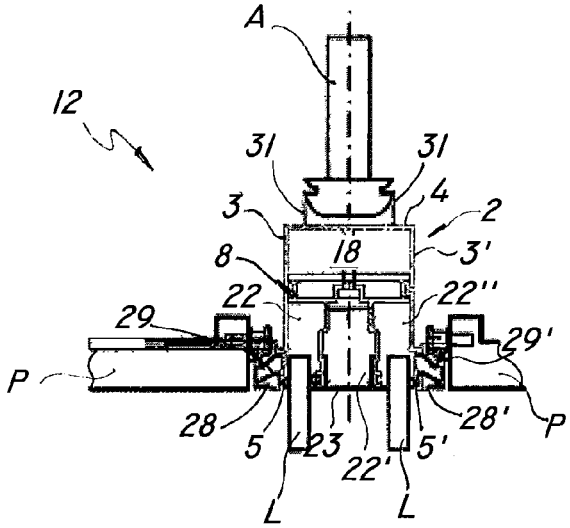
FIGS. 4 to 12 are respective cross-sectional views of a beam according to the invention, according to different preferred non-restrictive embodiments.
Figure 5:
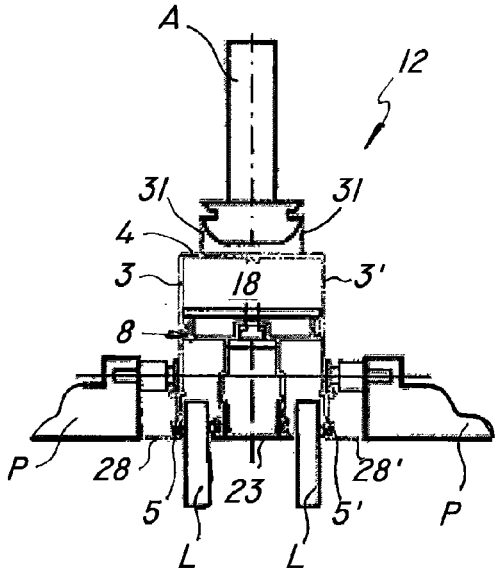

Likewise, the assembled false ceiling, as partially shown in FIGS. 4 and 5 and in FIGS. 9 to 12 and generally designated by numeral 12, will have no structural element projecting out of the plane it defined by the undersides of the panels P, which coincides with the plane of the opening 7.

The functional elements 8 will be completely integrated in the false ceiling, thereby providing a high aesthetic quality as compared with prior art solutions.

FIG. 1 shows a preferred, non exclusive configuration of a bearing profile 2 that is part of a multipurpose beam 1 of the present invention.

Figure 2:
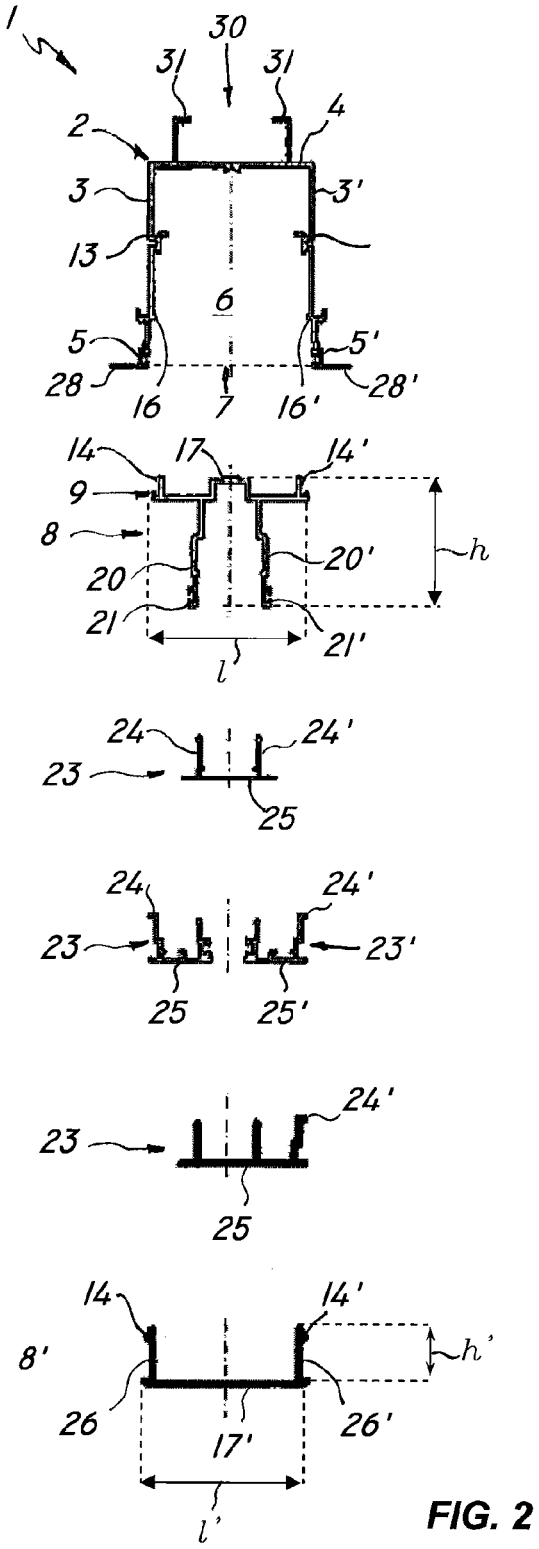
FIG. 2 is an exploded cross-sectional view of a beam according to the invention associated with a first set of accessories.
Figure 3:
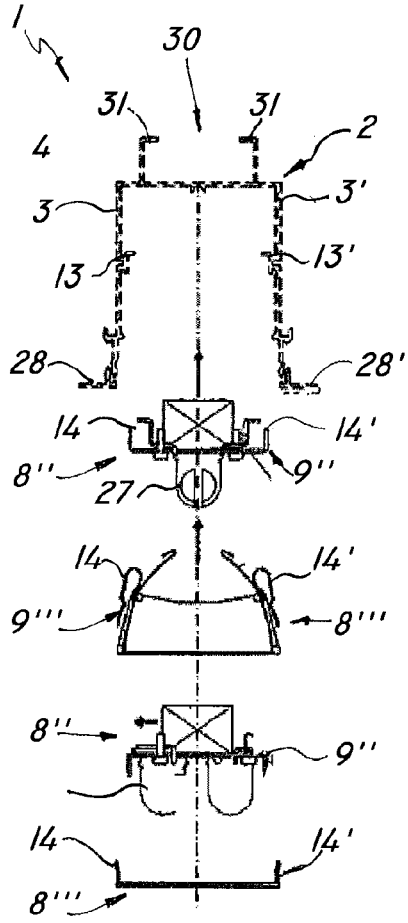
FIG. 3 is an exploded cross-sectional view of a beam according to the invention associated with a second set of accessories.

FIGS. 2 and 3 show a profile 2 and a plurality of functional elements 8, 8', 8'', 8''', . . . designed for selective association with the profile 2. The profile 2 and the functional elements 8 are shown in any cross section whatever.

Particularly, the coupling means 10 may be formed of one piece with the side walls 3, 3' and located within the compartment 6 at a predetermined distance $d_1$ from the bottom longitudinal edges 5, 5' along the vertical direction.

The coupling means 10 may include at least one pair of first lips or longitudinal ridges 13, 13' formed inside the compartment 6 and at least one pair of second lips or longitudinal ridges 14, 14' formed on the anchoring portion 9 of the functional element 8.

The first lips or ridges 13, 13' may extend longitudinally along part or the whole of the longitudinal extension of the profile 2.

Furthermore, the first lips 13, 13' may project to a sufficient extent to define a predetermined span 15 between their inner edges.

In the illustrated configuration, the coupling means 10 have two pairs of first longitudinal lips 13, 13'; 16, 16' situated inside the compartment 6.

Each of the of first Ups 13, 13'; 16, 16' may project out of corresponding side walls 3, 3' at different distances $d_1$, $d_2$ from the lower edges 5, 5' to define a lower pair 16, 16' and an upper pair 13, 13' designed to selectively interact with the anchoring portion 9 of the functional element 8 integrated from time to time in the profile 2.

Thus, the beam 1 will be even more versatile, allowing the profile 2 to be coupled with functional elements 8 of different transverse sizes without affecting integrability thereof in the false ceiling construction 12.

The functional element 8 will preferably have a longitudinal size substantially equal to that of the profile 2, but may also be shorter.

The functional element 8 may be coupled to the profile 2 by sliding it into the latter either in a longitudinal direction or in a vertical direction, and by subsequent snap connection.

Preferably, in order to avoid projecting parts, the anchoring portion 9 of the functional element 8 may have a maximum vertical extension h not exceeding the distance $d_1$, $d_2$ from the lower edges 5, 5' of the first pair of lips 13, 13'; 16, 16' with which it can be associated.

Particularly, in a first embodiment, the anchoring portion 9 of the functional element 8 may have a first substantially flat longitudinal formation 17, or be composed of a plurality of flat sections joined together, of sufficient width to obstruct the span 15 defined between the first lips 13, 13'; 16, 16'.

Thus, once the functional element 8 is coupled with the profile 2, it will divide the longitudinal compartment 6 into an upper longitudinal channel 18 for receiving service cables C or pipes, and a lower longitudinal channel 19 for receiving the functional element 8.

Figure 6:
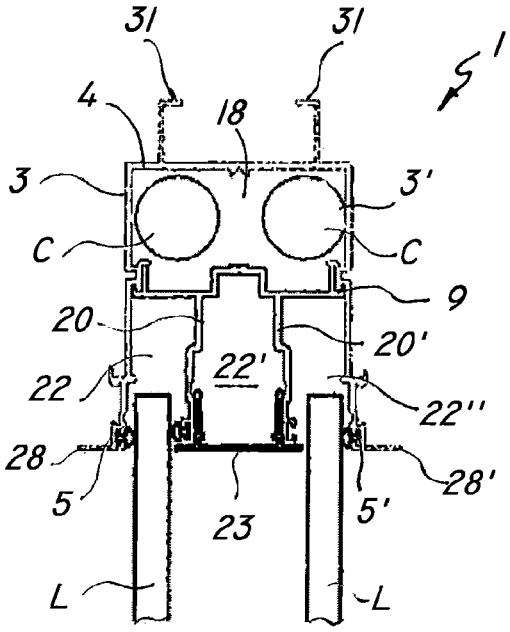
Figure 10:
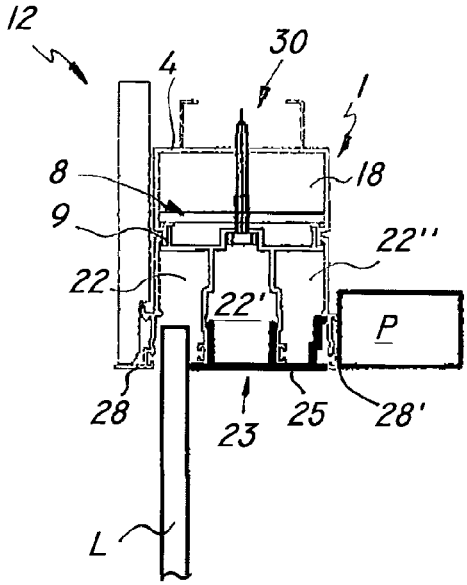
Figure 11:
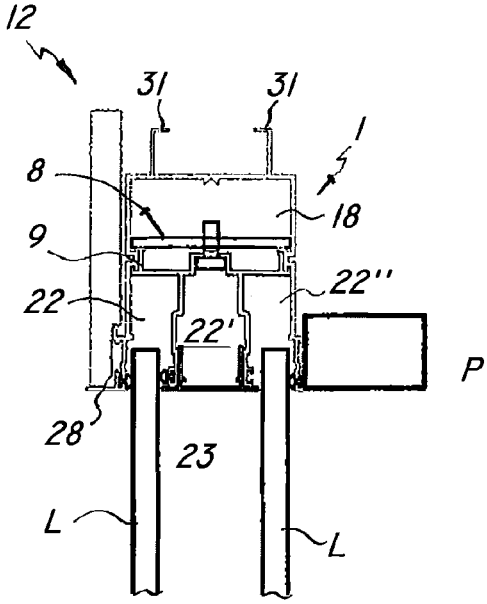
Figure 12:
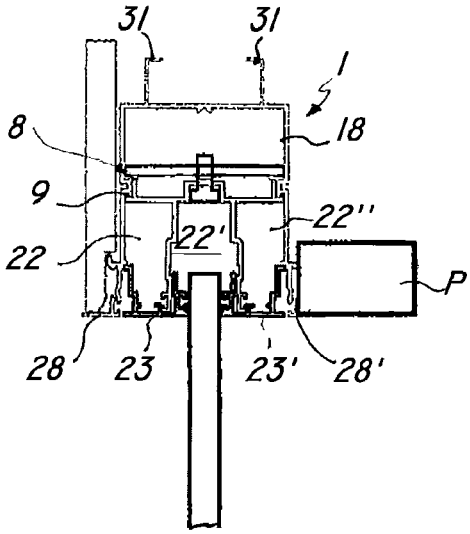

An exemplary configuration of a beam 1 whose compartment is divided into the two channels 18 and 19 is shown in FIGS. 4 to 6 and in FIGS. 10 to 12.

The first flat formation 17 may further have a pair of second lips or transverse ridges 14, 14', which are designed for snap engagement with one of the pairs of first lips or longitudinal ridges 13, 13', particularly with the upper pair, for anchoring the functional element 8 to the profile 2.

The anchoring portion 9 may include one or more pairs of vertical appendages 20, 20' having pairs of third lips or longitudinal ridges 21, 21' along their longitudinal edges.

The vertical appendages 20, 20' of the anchoring portion 9 may be transversely offset in a horizontal direction to divide the lower channel 19 into a plurality of longitudinal sectors 22, 22', 22", . . . .

In the illustrated configuration, two vertical appendages 20, 20' are provided, to define three longitudinal sectors 22, 22', 22".

The longitudinal sectors 22, 22', 22" will be designed to receive respective outer partition elements L of the space with which the false ceiling 12 is associated.

The beam 1 may also include one or more interface elements 23 designed for connection both to the profile 2 and to the functional element 8.

Each interface element 23 may be equipped with a pair of fourth lips or longitudinal ridges 24, 24' designed for snap connection with the pair of third lips or longitudinal ridges 21, 21' of the vertical appendages 20, 20'.

Advantageously, the interface element 23 may have at least one second substantially flat and horizontal formation 25 for selectively obstructing access to one or more of the longitudinal sectors 22, 22', 22".

For instance, as shown in FIGS. 4 to 6 and in FIG. 11, the interface element 23 may be in a position in which its second flat formation 25 obstructs access to the central sector 22', while leaving the lateral sectors 22, 22' clear for partial insertion of a partition element L, such as a prefabricated panel, a glazed wall, a curtain, or the like.

Alternatively, the interface element 23 may have a second flat formation 25 whose transverse and horizontal size is sufficient to obstruct access to two adjacent sectors 22', 22", as shown in FIG. 10. In this case, one partition element L may be inserted.

Figure 9:
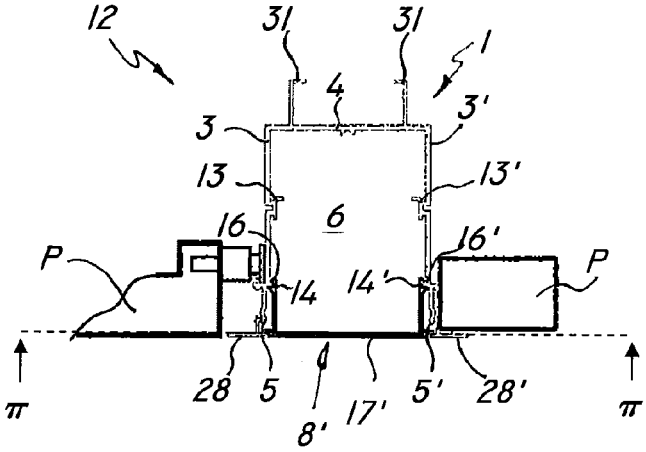

According to yet another alternative, two similar interface elements 23, 23' may be provided, which are symmetrical with respect to a vertical plane. These elements 23, 23' may connect to a common functional element 8 to obstruct respective sectors, e.g. the lateral sectors 22, 22", and leave the central sector 22' clear.

in this case, as shown in FIG. 12, one partition element L may be inserted in a central position relative to the profile 2.

in a particular embodiment, as shown in FIG. 2 and FIG. 9, a functional element 8' may consist of a first flat formation 17' having a width l' substantially equal to that of the bottom opening 7 of the compartment 6.

The two vertical appendages 26, 26' that define the anchoring portion and respective second lips 14, 14' designed to be removably coupled with the lower pair of first lips or ridges 16, 16' associated with the profile 2 may extend upwards from the first flat formation 17'.

The anchoring portion 9 will also have a height substantially equal to the distance $d_2$ of the first lower lips 16, 16' from the lower edges 5, 5' for its flat formation 17' to be maintained substantially flush with the bottom opening 7.

Such configuration will be particularly useful if no device is designed to be received inside the profile 2, i.e. if the beam 1 will be only used for receiving wiring or other feeding or service cables or pipes C.

Figure 7:
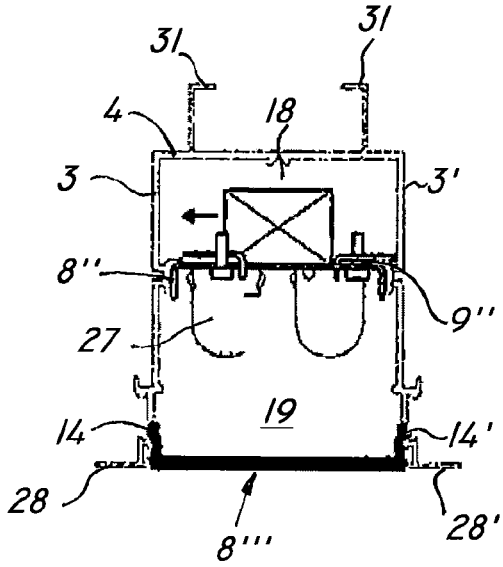
Figure 8:
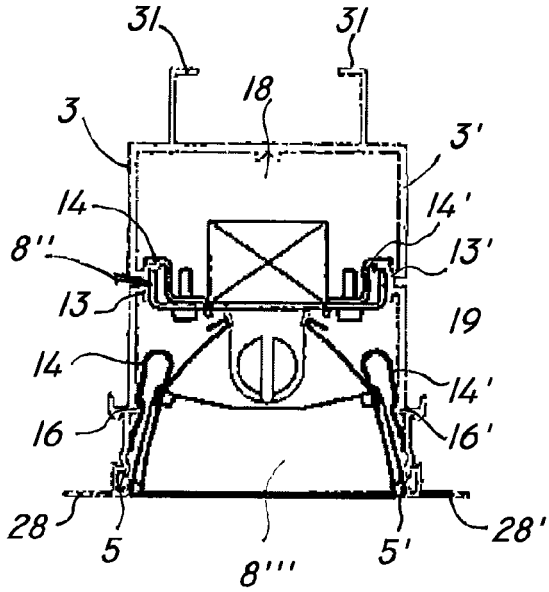

As shown in FIGS. 3, 7 and 8, the profile 2 may be associated with a functional element 8" comprising a light source 27. In this case, the functional element 8" may include a substantially flat anchoring portion 9" having a pair of second lips 14, 14' and with a lighting prism or another lighting source 27, of traditional, LED, or any other type attached thereto.

Likewise, the profile 2 may be associated with a sound device, an alarm or another safety device, such as a fire system, not shown.

An additional functional element 8" may be also provided, such as a ceiling lamp, a reflecting bowl, a diffuser or a transparent cover, to be mounted underneath the other functional element 8".

The second functional element 8'" may have an anchoring portion 9'" adapted to be coupled to the lower pair of first lips 16, 16', thereby being entirely contained in the compartment 6 and integrated in the profile 2.

Advantageously, the support means 11 for supporting the panels P may include a pair of side appendages 28, 28' which are formed at the free bottom edge 5, 5' of respective side walls 3, 3' and may extend along substantially the entire longitudinal extension of the profile 2.

The side appendages 28, 28' may project outwards to define respective abutment surfaces for corresponding panels P of a false ceiling construction 12.

The support means 11 may also include additional brackets 29, 29' which are adapted to be laid or secured to respective side appendages 28, 28' to ensure coupling with the side edges of corresponding panels P. Such solution may be suitable, for example, for a false ceiling 12 providing sound insulation, as partially shown in FIG. 4.

Furthermore, the profile 2 may also have anchor means 30 associated to the top wall 4, for fixation thereof to a ceiling.

For example, the anchor means 30 may include an upwardly open C-shaped formation 31 integral with the top wall 4 with the terminals of a hanger system A being designed to be hooked to its folded edges, in a substantially known manner.

The C-shaped formation 31 may have a maximum width smaller than that of the top wall 4 of the profile 2, thereby leaving the side lateral portions of the top wall 4 clear. Such lateral portions will advantageously act as shoulders for abutment of respective vertical panels, to form a sound insulation partition, not shown.

Particularly, the sound insulation partition may consist of a pair of side panels, each having an inner layer abutting against its respective shoulder, and an outer layer joined to the former by self-tapping screws or similar members. An insulation pad of known type may be interposed between the inner layers.

A false ceiling structure 12 according to the present invention comprises one or more multipurpose beams 1 as described above, which are designed to be connected in a well-known manner to the bearing structure of a building to define a truss for supporting the false ceiling panels P.

The false ceiling structure 12 further comprises at least one pair of panels P designed to be associated with a corresponding beam 1, and whose underside is exposed.

As mentioned above, the beam 1 has support means 11 for supporting the of panels P, which are associated to its side wads 3, 3' in the proximity of the lower edges 5, 5'.

According to the invention, the support means 11 are designed to maintain the undersides of the panels P within a plane π substantially flush with the bottom opening 7 of the profile 2. This will eliminate any discontinuity in the false ceiling 12, thanks to the integration of the beams 1 and hence the functional elements 8, 8', 8", 8'", that can be associated therewith, within the false ceiling construction 12.

In another aspect, the invention relates to a modular system for customized design of a false ceiling comprising one or more multipurpose beams 1 as described above, which can be associated with a plurality of functional elements 8, 8', 8", 8'", . . . .

The functional elements 8, 8', 8", 8'", . . . are designed to be removably and selectively anchored to the profile 2 of the beam 1, to change the configuration of the beam 1 as requested by the configuration that is selected from time to time within the space with which the false ceiling 12 is associated.

Thus, whenever the partitioning arrangement of the space with which the false ceiling 12 is associated has to be changed, e.g. divided into an increased or decreased number of rooms, or if its use has to be changed, e.g. from an office to a technical room or vice versa, one will simply remove the functional element 8, 8', 8", 8'", . . . integrated in the profile 2 and replace it with a now functional element 8, 8', 8", 8'", . . . that fits the new configuration.

By way of example, assuming that a single room, in which a false ceiling 12 with a central beam 1 contains a lighting fixture 27 has to be divided into two separate rooms, one will simply remove the functional element 8" with the light source 27 and introduce a new functional element 8 and one or a pair of interface elements 23, 23' designed for supporting one or a pair of walls, panels, panes, curtains or the like L.

The above disclosure clearly shows that the invention fulfills the intended objects and particularly meets the requirement of providing a multipurpose beam, a false ceiling structure and a modular system for customized design of false ceiling that affords superior aesthetic quality, simple construction and high versatility.

The beam, structure and system of the invention are susceptible to a number of changes and variants, within the inventive concept disclosed in the annexed claims. All the details thereof may be replaced by other technically equivalent parts, and the materials may vary depending on different needs, without departure from the scope of the invention.

While the beam, structure and system have been described with particular reference to the accompanying figures, the numerals referred to in the disclosure and claims are only used for the sake of a better intelligibility of the invention and shall not be intended to limit the claimed scope in any manner.

What is claimed is:

1. A multipurpose beam for side-by-side panel false ceiling constructions comprising:

a bearing profile designed to be suspended from a floor slab, said bearing profile having a pair of substantially vertical side walls that are joined together at their upper end by a substantially horizontal wall and that have free longitudinal lower edges to define a longitudinal compartment with a bottom opening;

at least one functional element having an anchoring portion designed to be inserted in said compartment;

coupling means connecting together said profile and said anchoring portion of said functional element; and support means associated with said profile and configured to support at least one panel of a false ceiling construction, wherein said anchoring portion of said at least one functional element is shaped to hold said functional element in a stable position within said profile, wherein said functional element is entirely contained within said compartment, wherein said coupling means include at least one pair of first lips or longitudinal ridges formed in said compartment and at least one pair of second lips or longitudinal ridges formed on said anchoring portion of the at least one functional element, wherein said first lips or ridges extend inwardly of said compartment at a predetermined distance from said lower edges and by a sufficient extension to define a span of predetermined width between their lower edges, wherein said support means extend from said side walls of said profile to hold panels substantially flush with said longitudinal edges of said opening, wherein said anchoring portion includes at least one pair of vertical extensions having a pair of third lips or longitudinal ridges along their longitudinal edges configured to couple said at least one functional element with at least one interface element designed for supporting one or more partition elements, and wherein said anchoring portion of said at least one functional element has a maximum vertical extension not greater than said predetermined distance of said pair of first lips from said lower edges.

2. The multipurpose beam as claimed in claim 1, wherein said coupling means are formed of one piece with said side walls and located at a predetermined vertical distance from said lower longitudinal edges.

3. The multipurpose beam as claimed in claim 1, wherein said functional element comprises one or more of a light or sound source.

4. The multipurpose beam as claimed in claim 1, wherein said coupling means include two of said pairs of first longitudinal lips located in said longitudinal compartment at different distances from said lower edges to define a lower pair and an upper pair, which are designed to selectively interact with said anchoring portion of said at least one functional element.

5. The multipurpose beam as claimed in claim 1, wherein said support means include a pair of side extensions formed at respective free lower edges of said side walls and projecting outwards to define respective abutment surfaces for corresponding panels of a false ceiling construction.

6. The multipurpose beam as claimed in claim 1, wherein said profile has anchoring means configured to provide anchoring to a floor slab.

7. The multipurpose beam as claimed in claim 6, wherein said anchoring means include an upwardly open C-shaped formation associated with said horizontal wall of said profile.

8. A multipurpose beam for side-by-side panel false ceiling constructions comprising:

a bearing profile designed to be suspended from a floor slab, said bearing profile having a pair of substantially vertical side walls that are joined together at their upper end by a substantially horizontal wall and that have free longitudinal lower edges to define a longitudinal compartment with a bottom opening;

at least one functional element having an anchoring portion designed to be inserted in said compartment;

coupling means connecting together said profile and said anchoring portion of said functional element; and support means associated with said profile and configured to support at least one panel of a false ceiling construction, wherein said anchoring portion of said at least one functional element is shaped to hold said functional element in a stable position within said profile, wherein said functional element is entirely contained within said compartment, wherein said coupling means include at least one pair of first lips or longitudinal ridges formed in said compartment and at least one pair of second lips or longitudinal ridges formed on said anchoring portion of the at least one functional element, wherein said first lips or ridges extend inwardly of said compartment at a predetermined distance from said lower edges and by a sufficient extension to define a span of predetermined width between their lower edges, wherein said support means extend from said side walls of said profile to hold panels substantially flush with said longitudinal edges of said opening, wherein said anchoring portion includes at least one pair of vertical extensions having a pair of third lips or longitudinal ridges along their longitudinal edges configured to couple said at least one functional element with at least one interface element designed for supporting one or more partition elements, and wherein said anchoring portion of said functional element has a first substantially planar longitudinal formation of sufficient width to occlude said span, said first substantially planar longitudinal formation dividing said longitudinal compartment into an upper longitudinal channel and a lower longitudinal channel, said upper longitudinal channel being configured to receive service cables or pipes, said lower longitudinal channel being configured to at least partially receive said functional element.

9. The multipurpose beam as claimed in claim 8, wherein said at least one pair of second lips or longitudinal ridges are formed on said first planar formation further and are designed for snap engagement with said of pair of first lips or longitudinal ridges, configured to anchor said functional element to said profile.

10. The multipurpose beam as claimed in claim 8, wherein a vertical extension of said anchoring portion is transversely offset along a horizontal direction to divide said lower channel into three longitudinal sectors, which are adapted to at least partially receive respective outer partition elements of a space with which the false ceiling is associated.

11. The multipurpose beam as claimed in claim 10, further comprising at least one interface element which is designed to be connected both to said profile and to said functional element and has at least one pair of fourth lips or longitudinal ridges designed for snap connection with said third pair of lips or longitudinal ridges associated with said anchoring portion.

12. The multipurpose beam as claimed in claim 11, wherein said interface element has at least one second substantially planar and horizontal formation configured to selectively occlude access to one or more of said longitudinal sectors.

13. A multipurpose beam for side-by-side panel false ceiling constructions comprising:

a bearing profile designed to be suspended from a floor slab, said bearing profile having a pair of substantially vertical side walls that are joined together at their upper end by a substantially horizontal wall and that have free longitudinal lower edges to define a longitudinal compartment with a bottom opening;

at least one functional element having an anchoring portion designed to be inserted in said compartment;

coupling means connecting together said profile and said anchoring portion of said functional element; and support means associated with said profile and configured to support at least one panel of a false ceiling construction, wherein said anchoring portion of said at least one functional element is shaped to hold said functional element in a stable position within said profile, wherein said functional element is entirely contained within said compartment, wherein said coupling means include at least one pair of first lips or longitudinal ridges formed in said compartment and at least one pair of second lips or longitudinal ridges formed on said anchoring portion of the at least one functional element, wherein said first lips or ridges extend inwardly of said compartment at a predetermined distance from said lower edges and by a sufficient extension to define a span of predetermined width between their lower edges, wherein said support means extend from said side walls of said profile to hold panels substantially flush with said longitudinal edges of said opening, wherein said anchoring portion includes at least one pair of vertical extensions having a pair of third lips or longitudinal ridges along their longitudinal edges configured to couple said at least one functional element with at least one interface element designed for supporting one or more partition elements, and wherein said anchoring portion of said at least one functional element has a first substantially planar longitudinal formation of sufficient width to occlude said span, said first planar formation of said anchoring portion having a width substantially equal to that of the bottom opening of said compartment, said anchoring portion also having a height substantially equal to said predetermined distance of said first lips from said lower edges for said first planar formation to be maintained substantially flush with said bottom opening.

* * * * *